US006267870B1

(12) United States Patent
Amor et al.

(10) Patent No.: US 6,267,870 B1
(45) Date of Patent: Jul. 31, 2001

(54) TREATING ALUMINUM WORKPIECES

(75) Inventors: Martin Philip Amor, Banbury; Jonathan Ball, Allcester, both of (GB)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 09/202,252

(22) PCT Filed: Jun. 17, 1997

(86) PCT No.: PCT/GB97/01635

§ 371 Date: Aug. 6, 1999

§ 102(e) Date: Aug. 6, 1999

(87) PCT Pub. No.: WO97/48839

PCT Pub. Date: Dec. 24, 1997

(30) Foreign Application Priority Data

Jun. 17, 1996 (EP) ..... 96304476

(51) Int. Cl.[7] ..... C25F 1/00

(52) U.S. Cl. ..... 205/705; 205/721

(58) Field of Search ..... 205/721, 705

(56) References Cited

U.S. PATENT DOCUMENTS 2,840,521 * 6/1958 Wasserman ..... 205/721
4,263,113 * 4/1981 Bernard ..... 205/721
5,283,206 2/1994 Sugano .

FOREIGN PATENT DOCUMENTS 657564 6/1995 (EP) .

* cited by examiner

*Primary Examiner*—Arun S. Phasge
(74) *Attorney, Agent, or Firm*—Cooper & Dunham, LLP

(57) ABSTRACT

Surface defects on rolled alulminium alloy sheet, particularly that intended for use as lithographic plate substrate, are caused by copper-containing particles. The invention provides a method of improving the sheet by removing the particles by anodising in an aggressive electrolyte, particularly a.c. anodising at a current density of at least 2 $kAm^{-2}$.

11 Claims, 7 Drawing Sheets

80 °C, CLEANING

60 °C, ANODIZING

80 °C, CLEANING

60 °C, ANODIZING

80 °C, CLEANING

60 °C, ANODIZING

TREATING ALUMINUM WORKPIECES

Rolled aluminium alloy sheet is extensively used as lithographic plate substrate, for which purpose it is finally processed by tension levelling and cleaning. On being electrograined in nitric acid, surface defects may arise which show up as ungrained mirror-like areas, typically 1–2.0 mm in diameter, in a matt grained surface and which lead to large rejection rates. One such area per 20 $m^2$ of rolled sheet can lead to rejection of the strip. This is an increasing problem because inspection is becoming more rigorous and graining is lighter.

This invention results from the inventors' discovery that these surface defects result from the presence of particles more noble than Al on the surface of the Al workpiece. Such particles most usually contain copper or consist of copper. The actual quantity of copper-containing metal deposited overall is very small and is extremely difficult to detect in the rolling production stages. Other contaminant metal particles are possible. This invention addresses the problem of surface defects in Al sheet by removal of metal particles contaminating the surface thereof. Removal of such particles is preferably effected at a late stage in production, after any likely sources of contamination have been passed. Of course, rolled Al sheet is cleaned, particularly for lithographic use but also for all other purposes; but it has been found that cleaning techniques in current use may not be effective to remove surface metal particles.

The invention provides a method of treating an Al workpiece to improve a surface thereof, which method comprises removing noble particles, e.g. Cu-containing particles present on the surface. Preferably removal is effected by subjecting the Al workpiece to electrolytic treatment, e.g. anodising the Al workpiece in an electrolyte capable of dissolving the metal particles. Preferably the Al workpiece is anodised at a current density of at least 2 $kAm^{-2}$.

The same particles may initiate corrosion in rolled sheet intended to be painted for architectural or automobile use; and in rolled sheet to which anodic oxide films or organic coatings are intended to be applied.

The workpiece is preferably rolled sheet or strip. The term Al is herein used to denote pure aluminium metal and alloys containing a major proportion of aluminium. While the invention is believed applicable to Al alloys generally, it is of particular importance in relation to 1000 and 3000 series alloys (of the Aluminum Association Inc. Register) intended for use as lithographic substrates, and also 5000 and 6000 series alloys intended for architectural or vehicle or other use.

The electrolyte, which needs to be capable of dissolving the metal particles, may be acidic or alkaline. Caustic soda and caustic potash are possible. Sulphuric acid is a possible electrolyte, optionally containing HF or other additives as in the cleaning fluid marketed by Henkel under the trademark Ridolene 124/120E. Preferred electrolytes are based on phosphorus oxyacids. This family of acids includes orthophosphoric acid $H_3PO_4$; metaphosphoric acid and pyrophosphoric acid based on $P_2O_5$; and also phosphorous or phosphonic acid $H_3PO_3$; hypophosphorous or phosphinic acid $H_3PO_2$; and perhaps others. As electrolytes with dissolving power for Cu (and for aluminium oxide) they all have generally similar properties.

Contamination of the sheet can occur at any stage in the rolling or handling process but is most likely to occur during hot rolling. The process according to the invention is preferably carried out after hot rolling has been completed. Lithographic sheet is normally cleaned after cold rolling to final gauge. The present treatment can be applied at that stage. However, there are practical advantages to removing contamination by cleaning at an earlier stage either on completion of hot rolling or at an intermediate stage in the cold rolling, for example after an intermediate anneal. Cleaning at this earlier stage has the following advantages:

1. The contaminating particles are less likely to be firmly rolled into the surface and therefore are more easily removed.
2. A portion of each contaminating particle becomes smeared over the surface as cold rolling proceeds and this smear increases the size of each resulting area to be removed.
3. As the sheet is cold rolled to progressively thinner gauge, the surface area to be cleaned increases resulting in increased cost of cleaning.

Cleaning at an earlier stage in the process does increase the risk of contamination arising later in the process remaining in place. However, this risk may be outweighed by the advantages listed above. Of course, the cleaning process can be repeated at later stages in the process and may in any case be followed by a conventional lighter cleaning operation.

The method involves anodising the Al workpiece, using either direct current or more preferably alternating current. When a.c. is used, it is supposed that electrolysis of the metal particles occurs when the Al surface is anodic. In addition, when the Al surface is made cathodic, copious quantities of hydrogen gas are formed all over the surface and blow loose debris off. The anodic action can also help to loosen particles of detritus by undercutting the surrounding Al substrate.

The a.c. wave form may be sinusoidal or not as desired. The a.c. current may be biased in either the cathodic or anodic direction. The a.c. frequency is at least several cycles per second and is preferably the commercial frequency.

Alternatively d.c. anodising may be used. While this is effective to loosen or dissolve metal particles, there is some risk that particles may be re-deposited. This risk can be avoided by causing the electrolyte to flow across the surface of the workpiece or by rapidly removing the workpiece from the electrolyte. Alternatively, d.c. anodisation for a period sufficient to loosen metal particles on the surface of the Al workpiece, can be followed by making the workpiece cathodic for a short period sufficient to generate a burst of hydrogen gas and blow the loosened particles away from the surface. Preferably the workpiece is removed from the bath under anodic conditions.

The concentration of phosphoric acid, or other electrolyte, is preferably from 5–30%, particularly 10–25% and more particularly 15–25% e.g. 20%. At low concentrations, the power of the acid to dissolve or loosen metal particles may not be sufficient. At high concentrations, the electrolyte may be so viscous that carry-over of electrolyte becomes a problem, particularly in continuous operations involving immersion for short periods.

The electrolyte temperature is preferably maintained at 50–100° C. Below 50° C., the dissolving power of the electrolyte may be too low. Although there is no theoretical upper limit of temperature, it is in practice inconvenient to heat phosphoric acid or other electrolytes to temperatures above 100° C. The preferred temperature for a phosphoric acid electrolyte is 80–100° C. e.g. 90° C. At temperatures of 70° C. and above, anodising can be performed under conditions to remove an aluminium oxide film from the surface of the workpiece, thus effectively cleaning the workpiece, and the treatment to remove metal particles according to this invention can thus be carried out in conjunction with cleaning. At temperatures in the range 50–80° C. (preferably 50–70° C. for Mg containing alloys) anodising can be performed under conditions to create or maintain an anodic aluminium oxide film, and this may increase the surface resistance of the Al workpiece and favour a current path through the metal particles. Thus operating under conditions to create, rather than remove, anodic aluminium oxide helps to remove the metal particles by electrolysis. The anodic film may be completely or partially dissolved if the strip is left in the electrolyte away from the influence of the electrodes.

A relatively high current density of at least about 2 $kAm^{-2}$ is preferred to remove metal particles. This is higher than the current densities ordinarily used when anodising or cleaning Al surfaces.

Treatment time can be very short e.g. as low as 0.1 s. It is envisaged that treatment will be performed by passing rolled strip continuously through a treatment bath which may, depending on other production line parameters, need to be done at high speed. The treatment time is thus the time spent in the electrolyte. Treatment times are preferably in the range of 0.5–30 s. The period of time during which the workpiece is in the vicinity of the electrodes and undergoes electrolytic treatment may be less than the total treatment time, and is preferably at least 0.25 s, in particular in the range 0.25–15 s or 0.25–5 s or 0.25–3 s e.g. around 0.5 s The total charge input is expected to be in the range of 0.2–50 or 0.2–30 $kCm^{-2}$ e.g. around 1 $kCm^{-2}$.

Preferred conditions for operating the process according to the invention are summarised as follows:

A.C. electrolytic treatment for at least 0.25 seconds under the electrode preferably 0.25–3 seconds e.g. around 0.5 s.

Phosphoric acid electrolyte at 80–100° C. e.g. 90° C.

Acid concentration in the electrolyte 15–25% e.g. 20%.

Current density at least 2 $kAm^{-2}$.

BRIEF DESCRIPTION OF THE DRAWINGS

Reference is directed to the accompanying drawings, in which each of FIGS. 1 to 11 is a micrograph, or a set of micrographs, of an Al alloy surface contaminated with Cu-containing particles. In these micrographs, the Al metal surface appears as a grey streaked background. Cu-containing particles appear white. SiC particles, which are an artefact of the experimental technique used, appear dark.

The following examples illustrate the invention.

EXAMPLE 1

Electrolytic vs Acid Etch

To demonstrate the efficiency of cleaning coil contaminated with copper containing particles, two samples of final gauge 0.3 mm coil were impregnated with fine copper and 70/30 brass particles by lightly rolling them into the surface. The particles were produced by abrading copper and brass with silicon carbide paper. Sufficient samples of each particulate could then be collected, although some transfer of the silicon carbide abrasive also occurred.

Figure 1:
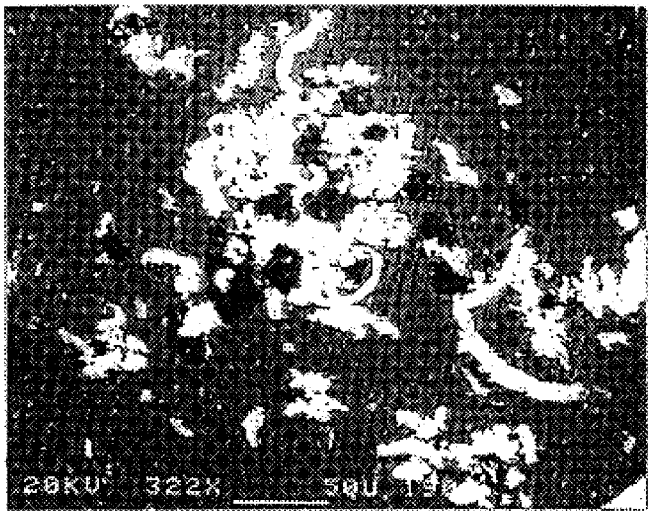

Anodising was effected using a 20% phosphoric acid electrolyte at 80° C. for three seconds at 3 volts. The comparative experiment used the proprietary etch Ridolene 124/120E, which is a 0.5% sulphuric acid, with dispersants and 300 ppm HF and one of the fastest proprietary etches. Samples were immersed for a period of 60 seconds at 60°0 C. A total of 6 samples were produced, these are:

FIG. 1: Brass particles rolled into 1050A alloy.

Figure 2:
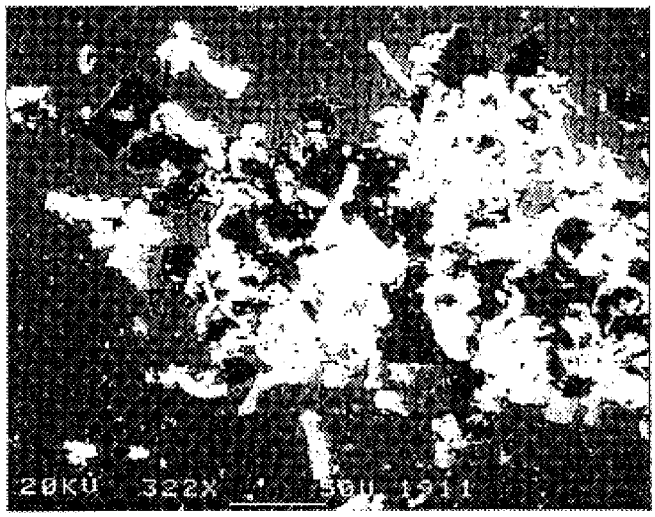

FIG. 2: Brass particles rolled into 1050A alloy Ridolene cleaned.

Figure 3:
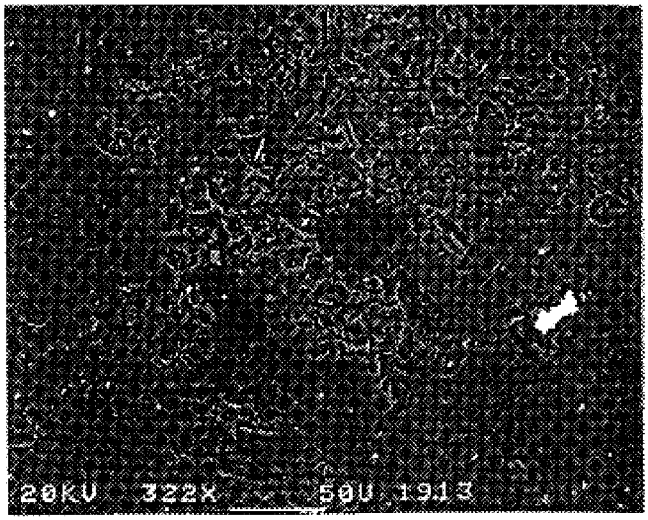

FIG. 3: Brass particles rolled into 1050A alloy phosphoric acid anodised.

Figure 4:
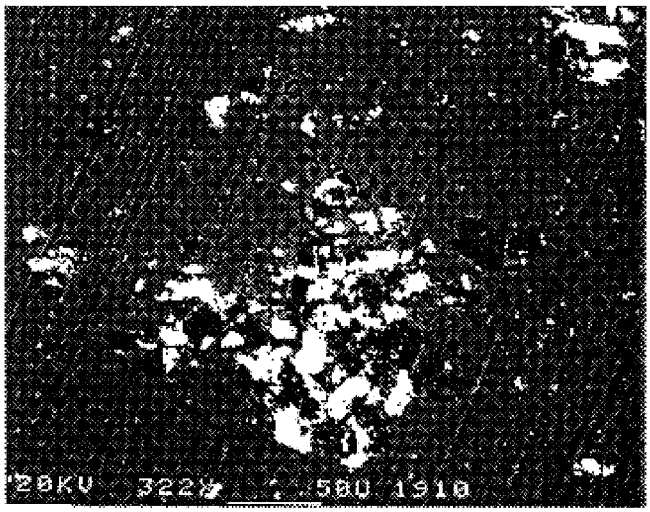

FIG. 4: Copper particles rolled into 1050A alloy.

Figure 5:
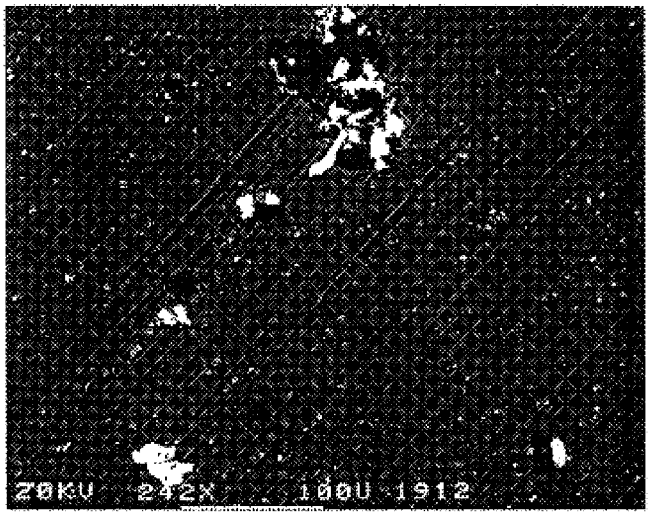

FIG. 5: Copper particles rolled into 1050A alloy Ridolene cleaned.

Figure 6:
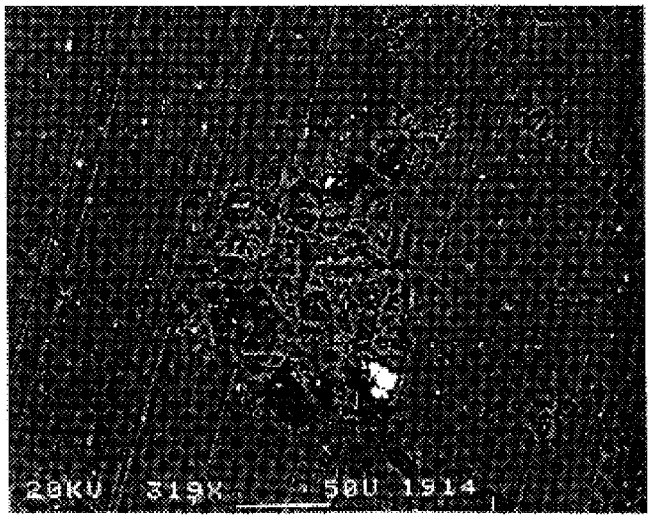

FIG. 6: Copper particles rolled into 1050A alloy phosphoric acid anodised.

The samples were examined with a scanning electron microscope using a back-scattered detector. FIG. 1 shows the frequency of the number of brass particles in the as rolled condition only. The darker-than-matrix particles of silicon carbide can also be seen. After cleaning in Ridolene for 60 seconds, (FIG. 2) all of the brass particles still remain. However the 3 second phosphoric acid anodisation has removed the majority of particles (including many of the coarser silicon carbide particles) with only one brass particle remaining as shown in FIG. 3. A similar story exists for the rolled-in copper particles. FIG. 4 gives detail of the rolled-in copper particles before cleaning. Again the Ridolene clean shows little effect on the removal of the copper particles (FIG. 5) but in contrast the three second phosphoric acid anodisation has removed nearly all of the particles as is shown in FIG. 6.

This simulation demonstrates the efficiency of the phosphoric acid anodisation in removing the copper containing particles versus the Ridolene clean.

EXAMPLE 2

Cleaning vs Anodising

It was thought that by anodising (at 60° C.) rather than cleaning (at 80° C.) the surrounding aluminium surface would be rendered slightly more passive and allow the cleaning action to concentrate on the copper particles.

Figure 7:
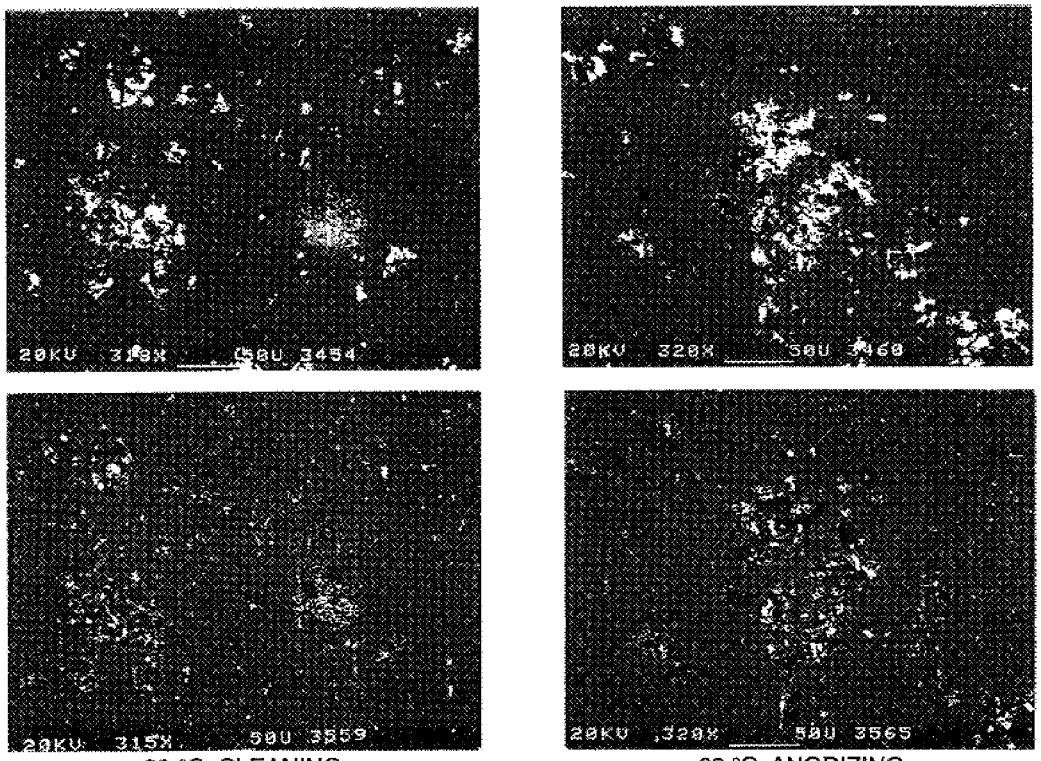
Figure 8:
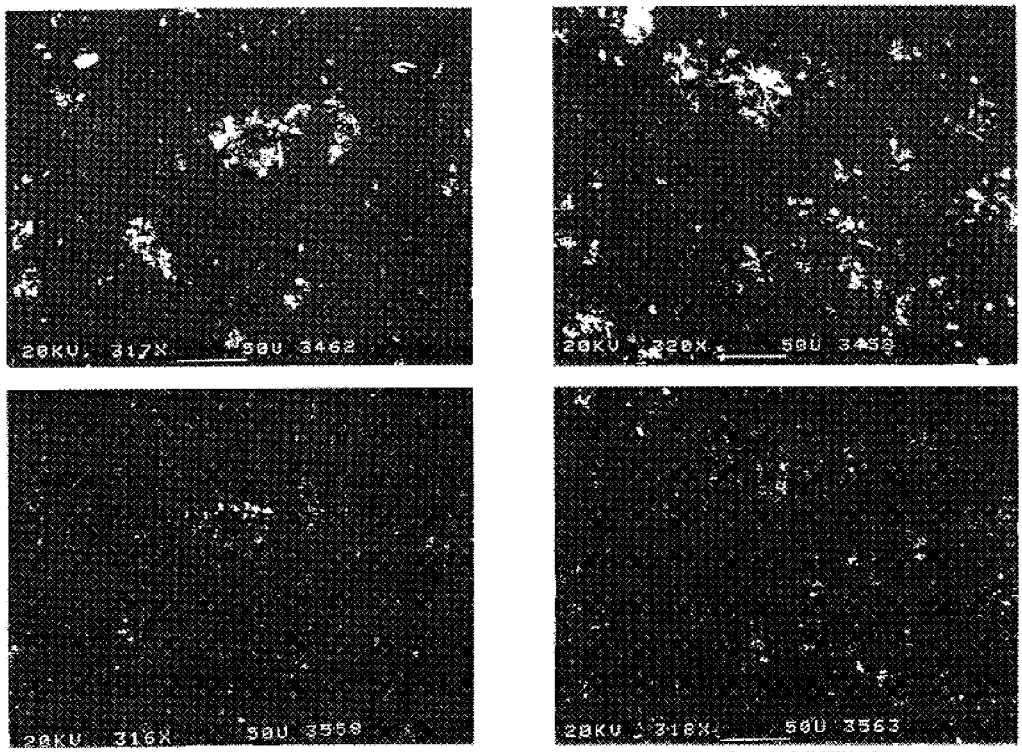
Figure 9:
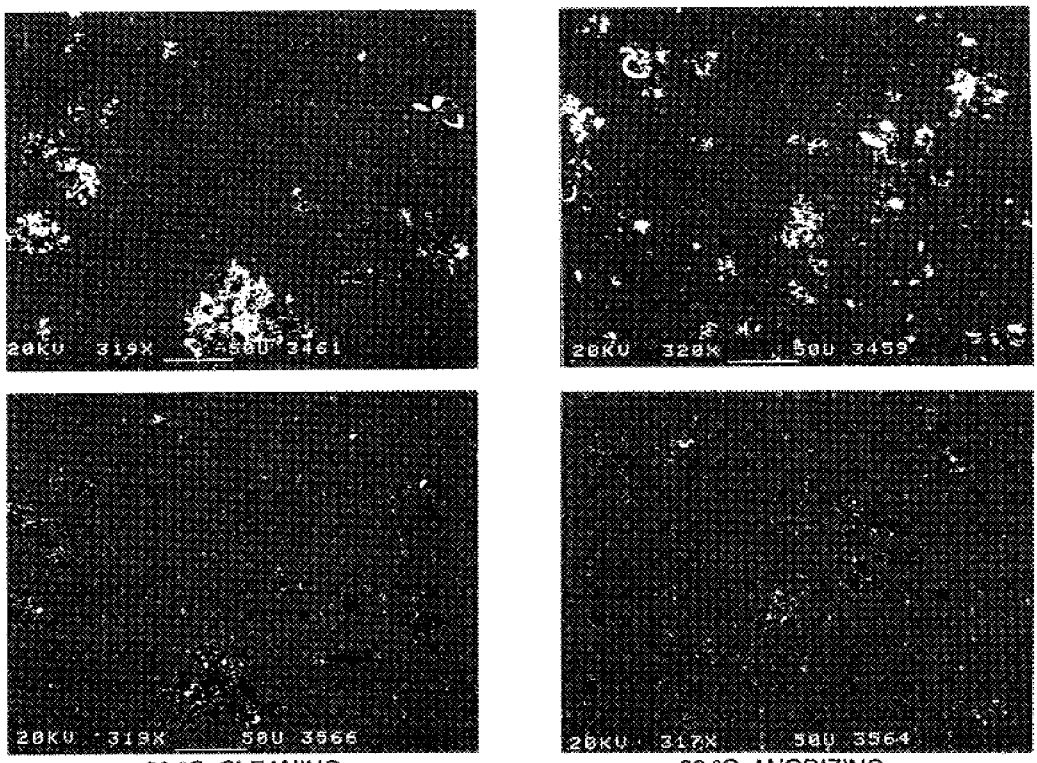

Samples of 1050A final gauge 0.3 mm coil were impregnated with fine copper particles as before. They were then cleaned or anodised under conditions that simulate commercial conditions, e.g. 20% phosphoric acid electrolyte at 80° C. and 60° C. respectively for 0.5 seconds. Three different a.c. voltage levels were employed namely 3, 7 and 15 volts (FIGS. 7, 8 and 9 respectively). In order to determine the passivating effect of the film generated by the two processes samples were immersed in a 3% NaOH solution at 60° C. and the time was measured until gassing occurred. In all cases the times were acceptably small (1.5–3.7 s) indicating that passivation is not a problem.

Each surface to be treated was initially characterised using the SEM, and after treatment the same area was examined. The SEM examination was done using the back-scattered detector so that the higher atomic number contrast of any remaining copper found on the surface after treatment could be observed.

The SEM photographs are shown in FIGS. 7 to 9. The top set of photographs are before treatment and the corresponding bottom set are after cleaning (80° C.) or anodising (60° C.). It was found that at the 15 volt treatment (FIG. 9) the particles were most effectively removed in 0.5 sec. There was no observable difference between cleaning and anodising, however there was a greater whitening effect generated by the cleaning treatment.

The applied current for the 15 volt 60° C. condition was 2300 $Amps/m^2$ and for the 80° C. condition the applied current was 3700 $Amps/m^2$.

EXAMPLE 3

DC Anodising

Figure 10:
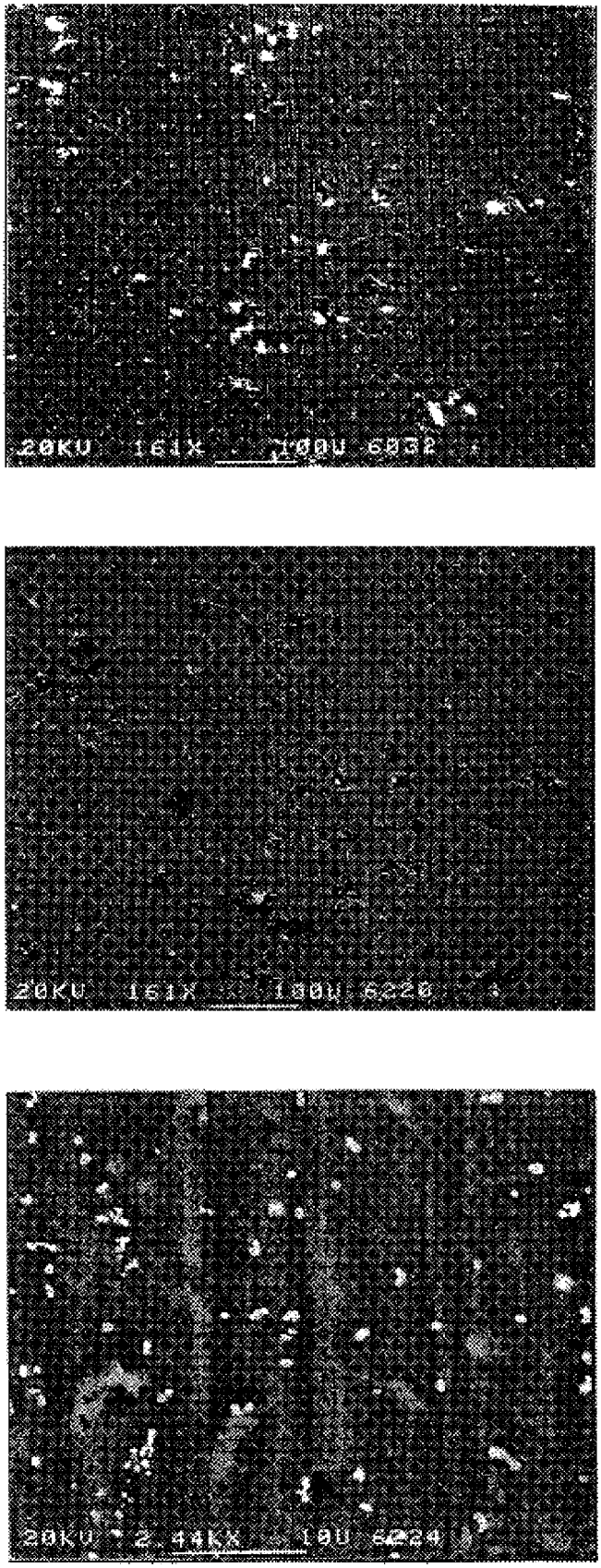
Figure 11:
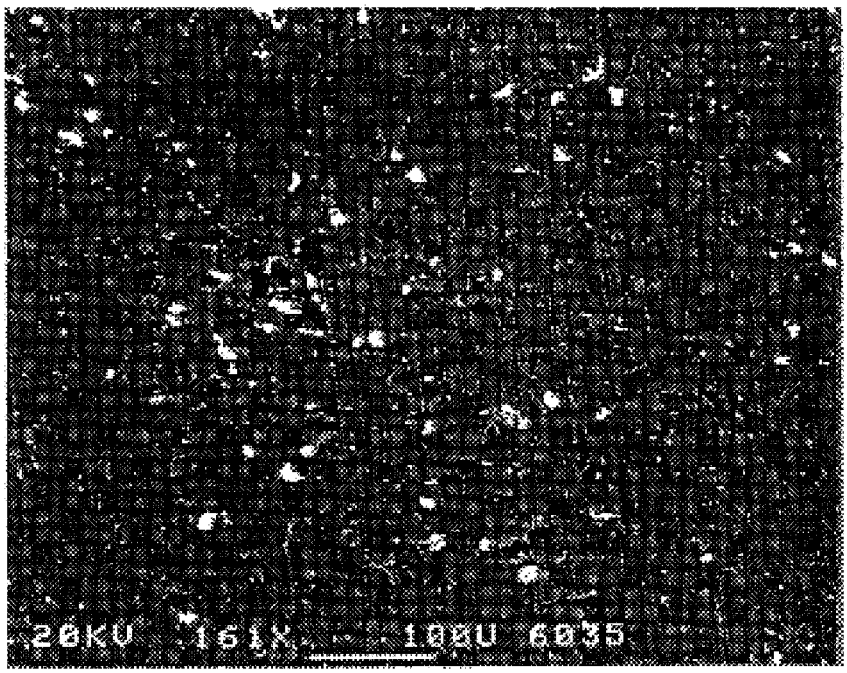
Figure 11:
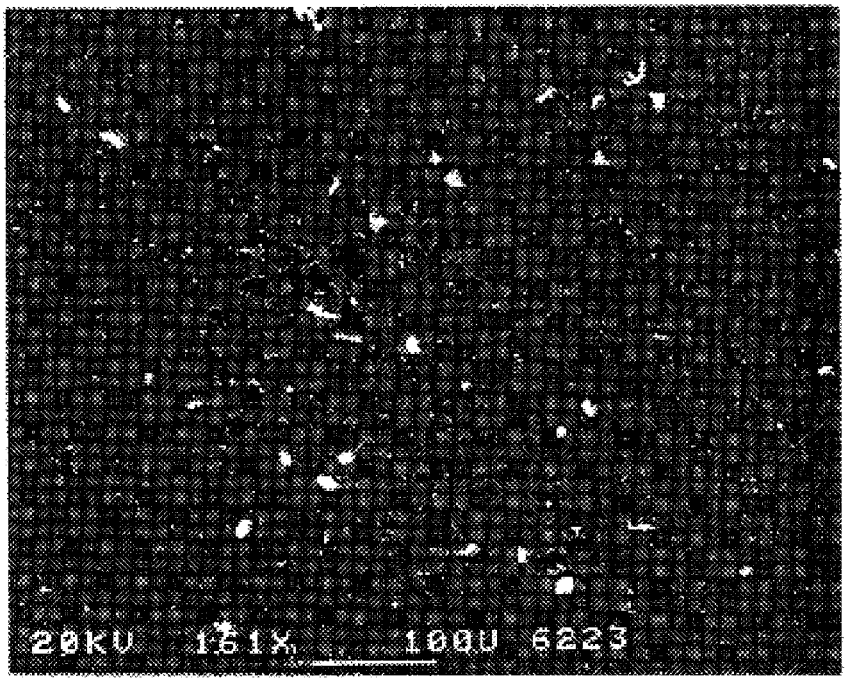

Anodising 1050A alloy with d.c. removes the particles but tends to result in copper particles being redeposited. A current density of 3000 $Amps/m^2$ was most favourable, FIG. 10 where the top micrograph is of the sample as received and the other two show, at different magnifications, the surface after d.c. anodic cleaning. However the copper which has gone into solution has, at least in part, been redeposited on the surface. Cathodic d.c. was not effective at removing the copper particles even at 3000 Amps/$m^2$, FIG. 11 where the top micrograph is of the sample as received and the bottom one shows the surface after d.c. cathodic cleaning. This tends to prove that removal is primarily by electrolysis.

EXAMPLE 4

A.C. Cleaning On A Continuous Line

A strip of AA1050A material was passed through two cleaning cells containing 18% phosphoric acid at 90° C., which applied power in the liquid contact mode. The line speed was 40 m/min. the strip width was 1.37 m and the gauge 2.2 mm, that is, the coil was treated after interannealing, but before further cold rolling to a final gauge of 0.275 mm. the current and charge densities used were 2.3 kA/$m^2$ and 5.5 kCoulombs/$m^2$ respectively and the voltage applied was 24 volts. The number of defects detected after graining in nitric acid under normal commercial conditions was ten times less than in identical material rolled and cleaned under standard commercial conditions. Further optimisation of the cleaning step is expected to reduce the number of defects still further.

What is claimed is:

1. A method of treating an Al workpiece to improve a surface thereof, which method comprises removing particles more noble than aluminium present in the surface, wherein the particles are removed by subjecting the Al workpiece to electrolytic treatment in a phosphorus oxyacid electrolyte.

2. A method as claimed in claim 1, wherein the particles are contaminant metal particles.

3. A method as claimed in claim 2, wherein the particles are copper-containing particles.

4. A method as claimed in claim 1, wherein the particles are copper-containing particles.

5. A method as claimed in claim 1, wherein removal is effected by anodising the Al workpiece in an electrolyte capable of dissolving the metal particles.

6. A method as claimed in claim 4, wherein the Al workpiece is anodised at a current density of at least 2 $kAm^{-2}$.

7. A method as claimed in claim 5, wherein a.c. anodising is used.

8. A method as claimed in claim 4, wherein d.c. anodising is used with the electrolyte being caused to flow across the surface of the workpiece.

9. A method as claimed in claim 1, wherein the Al workpiece is of a 1000 or 3000 series alloy of the Aluminum Association Inc. Register.

10. A method as claimed in claim 1, wherein the Al workpiece is rolled metal sheet for use as a lithographic plate support.

11. A method as claimed in claim 1, wherein the Al workpiece has been rolled prior to the step of removing particles present in the surface, and is again rolled after the said step.

* * * * *